US006419197B2

(12) United States Patent
Kochanski et al.

(10) Patent No.: US 6,419,197 B2
(45) **Date of Patent: *Jul. 16, 2002**

(54) KEYBOARD SUPPORT SYSTEM

(75) Inventors: Walter T. Kochanski, Fort Wayne; Curtis G. Berndt, Fremont; Edward J. Keil, Rome City; Phillip McCoy, Albion, all of IN (US); Tracy Tolar, Indian Rocks Beach, FL (US)

(73) Assignee: Group Dekko Services, LLC, Kendallville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/876,471

(22) Filed: Jun. 7, 2001

Related U.S. Application Data

(63) Continuation of application No. 09/599,323, filed on Jun. 22, 2000, now Pat. No. 6,293,508, which is a continuation of application No. 09/232,991, filed on Jan. 19, 1999, now Pat. No. 6,079,680.

(51) Int. Cl.[7] ..... A47F 1/10; A47B 96/06; F04G 5/06

(52) U.S. Cl. ..... 248/298.1; 248/231.81; 248/918; 108/97; 108/96

(58) Field of Search ..... 248/231.81, 918, 248/118, 118.1, 118.5, 205.1, 220.22, 225.11, 227.2, 231.61, 231.71, 276.1, 279.1, 291.1, 292.14, 295.11, 917, 919, 920, 298.1; 108/96, 97, 65

(56) References Cited

U.S. PATENT DOCUMENTS

| | | | | |
|---|---|---|---|---|
| 1,223,637 | A | 4/1917 | Swain | |
| 2,709,563 | A | 5/1955 | Starkey | 248/226 |
| 2,914,191 | A | 11/1959 | Bowden et al. | 211/153 |
| 3,647,078 | A | 3/1972 | Fortunato | 211/134 |
| 3,741,131 | A | 6/1973 | Leadbetter | 108/97 |
| 3,989,213 | A | 11/1976 | Allen | 108/97 |
| 4,316,082 | A | 2/1982 | Fritz | 235/146 |
| 4,616,798 | A | 10/1986 | Smeenge et al. | 248/281.1 |
| 4,632,349 | A | 12/1986 | Anstey | 248/281.1 |
| 4,648,574 | A | 3/1987 | Granlund | 248/349 |
| 5,041,770 | A | 8/1991 | Seiler et al. | 318/265 |
| 5,211,367 | A | 5/1993 | Musculus | 248/279.1 |
| 5,230,289 | A | 7/1993 | George et al. | 108/2 |
| 5,273,250 | A | 12/1993 | Pemberton et al. | 248/918 |
| 5,317,977 | A | 6/1994 | Omessi | 108/97 |
| 5,320,313 | A | 6/1994 | Crowe | 248/231.61 |
| 5,351,897 | A | 10/1994 | Martin | 244/118 |
| 5,386,957 | A | 2/1995 | Miller | 248/118.5 |
| 5,490,466 | A | 2/1996 | Diffrient | 108/96 |
| 5,564,667 | A | 10/1996 | Copeland et al. | 248/278.1 |
| 5,582,375 | A | 12/1996 | Martin | 248/118.3 |

(List continued on next page.)

*Primary Examiner*—Kimberly T. Wood
(74) *Attorney, Agent, or Firm*—Taylor & Aust, P.C.

(57) ABSTRACT

A keyboard support system attaches to an edge of a work surface. The work surface includes a working surface and an underside. The keyboard support system includes a keyboard platform configured for supporting a keyboard. A U-shaped mounting bracket includes a top wall having a lower surface, a monolithic bottom wall and a middle wall interconnecting the top wall and the bottom wall. The bottom wall has an upper surface and a lower surface with a pair of integral, opposing guide rails projecting therefrom. Each guide rail has a length oriented substantially parallel to the bottom wall. The middle wall is configured to both resiliently bias the lower surface of the top wall against the working surface of the work surface and resiliently bias the upper surface of the bottom wall against the underside of the work surface, thereby clamping the work surface between the top wall and the bottom wall. A sliding device is retained between the guide rails of the bottom wall and is slidably positioned along the lengths of the guide rails. A mounting arm interconnects the keyboard platform and the sliding device.

3 Claims, 4 Drawing Sheets

U.S. PATENT DOCUMENTS

| | | | | |
|---|---|---|---|---|
| 5,611,608 | A | 3/1997 | Clausen | 312/223.3 |
| 5,661,605 | A | 8/1997 | Conway | 361/680 |
| 5,692,712 | A | 12/1997 | Weinschenk, Jr. | 248/118 |
| 5,697,303 | A | 12/1997 | Allan | 108/93 |
| 5,730,408 | A | 3/1998 | McAllister et al. | 248/288.51 |
| 5,735,222 | A | 4/1998 | Webb | 108/114 |
| 5,775,657 | A | 7/1998 | Hung | 248/289.1 |
| 5,832,840 | A | 11/1998 | Woof | 108/6 |
| 5,836,562 | A | 11/1998 | Danzyger et al. | 248/295.11 |
| 5,848,773 | A | 12/1998 | Bourassa | 248/298.1 |
| 5,876,002 | A | 3/1999 | White et al. | 248/118 |
| 6,079,680 | A | 7/2000 | Kochanski et al. | 248/231.81 |
| 6,116,557 | A | 9/2000 | Choy et al. | 248/286.1 |
| 6,293,508 | B1 * | 9/2001 | Kochanski et al. | 248/231.81 |

* cited by examiner

KEYBOARD SUPPORT SYSTEM

This is a continution of application Ser. No. 09/599,323 filed Jun. 22, 2000, now Pat. No. 6,293,508 issued Sep. 25, 2001 which is a continaution of application Ser. No. 09/232,991 filed Jan. 19, 1999, now Pat. No. 6,079,680 issued Jun. 27, 2000.

BACKGROUND OF THE INVENTION

1. Field of the Invention

The present invention relates to mounting brackets for supporting a keyboard platform and attaching the keyboard platform to a work surface.

2. Description of the Related Art

It is known to screw or otherwise fasten a mounting bracket to the underside of a work surface. The mounting bracket has guide rails for retaining a sliding mechanism which is connected to a mounting arm. The mounting arm, in turn, is connected to and supports a keyboard platform on which a keyboard rests. A problem is that it is difficult and time-consuming to fasten the mounting bracket to the underside of the work surface. Another problem is that, once installed, the mounting bracket is also difficult to remove, and thus may be a hinderance to other work that may need to be done under the work surface. Yet another problem is that the mounting bracket is not easily portable, i.e., it is difficult to transfer the mounting bracket to another location, such as another desk.

What is needed in the art is a keyboard support system which can be quickly and easily attached to a work surface.

SUMMARY OF THE INVENTION

The present invention provides a keyboard support system which resiliently attaches onto the edge of a work surface.

The invention comprises, in one form thereof, a keyboard support system which attaches to an edge of a work surface. The work surface includes a working surface and an underside. The keyboard support system includes a keyboard platform configured for supporting a keyboard. A U-shaped mounting bracket includes a top wall having a lower surface, a monolithic bottom wall and a middle wall interconnecting the top wall and the bottom wall. The bottom wall has an upper surface and a lower surface with a pair of integral, opposing guide rails projecting therefrom. Each guide rail has a length oriented substantially parallel to the bottom wall. The middle wall is configured to both resiliently bias the lower surface of the top wall against the working surface of the work surface and resiliently bias the upper surface of the bottom wall against the underside of the work surface, thereby securing the work surface between the top wall and the bottom wall. A sliding device is retained between the guide rails of the bottom wall and is slidably positioned along the lengths of the guide rails. A mounting arm interconnects the keyboard platform and the sliding device.

An advantage of the present invention is that the keyboard support system can be both installed and removed in a quick and easy fashion.

Another advantage is that guide rails are integrally fabricated on the bottom wall of the mounting bracket, thereby eliminating the need to attach such mounting brackets to the underside of a work surface.

Yet another advantage is that stationary supplies may be retained in indentations in the top wall of the mounting bracket, thereby making such supplies more accessible to the user. A fixed, removable plastic or elastomeric piece having such indentations may be snapped onto or slid onto the top wall of the mounting bracket.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 2:
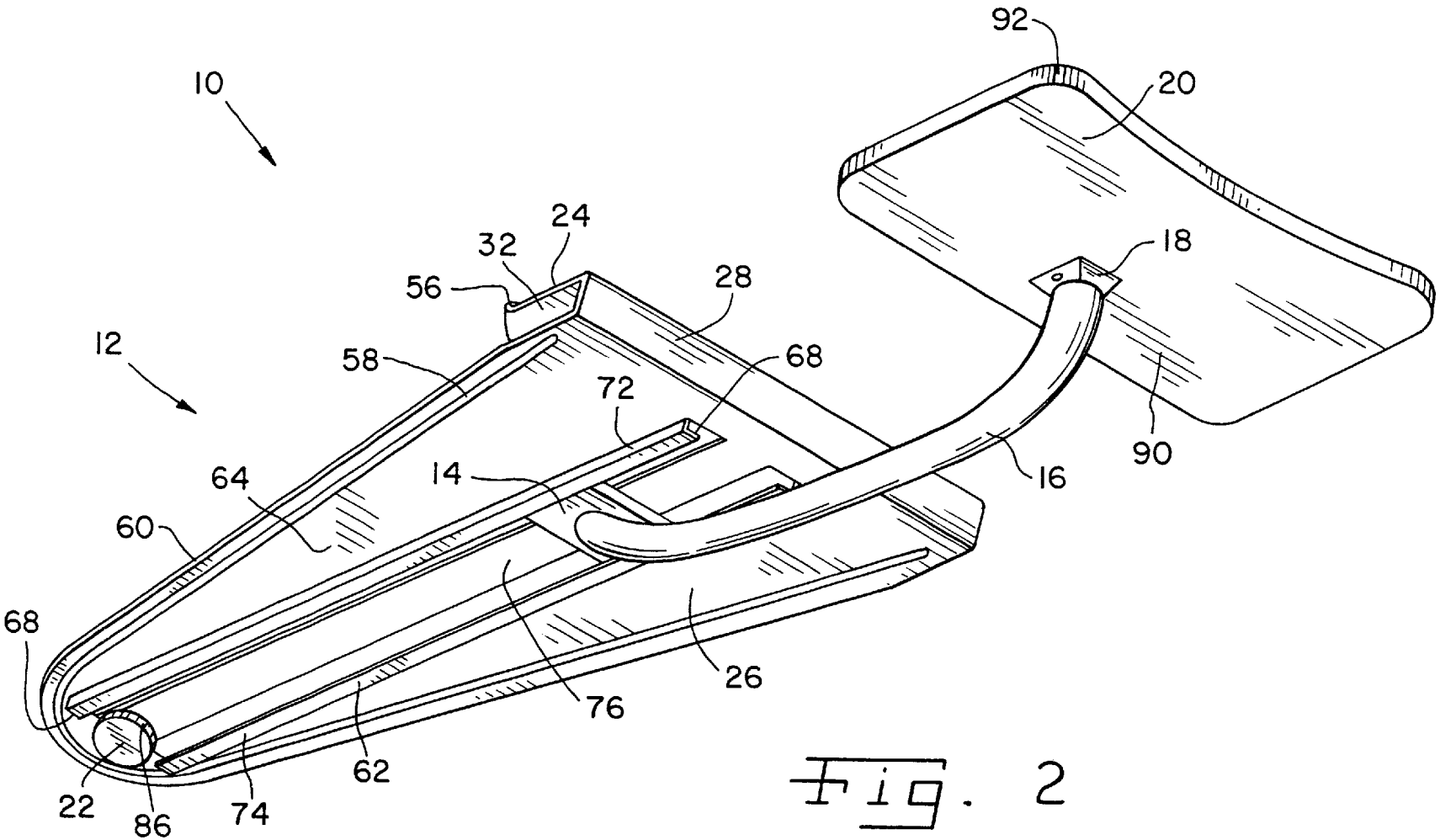
FIG. 2 is an upward, perspective view of the keyboard support system of FIG. 1.

Referring now to the drawings and particularly to FIG. 2, there is shown one embodiment of a keyboard support system 10 of the present invention. Keyboard support system 10 includes a U-shaped mounting bracket 12, a sliding device 14, a mounting arm 16, a pivot joint 18, a keyboard platform 20 and a knob 22.

Figure 1:
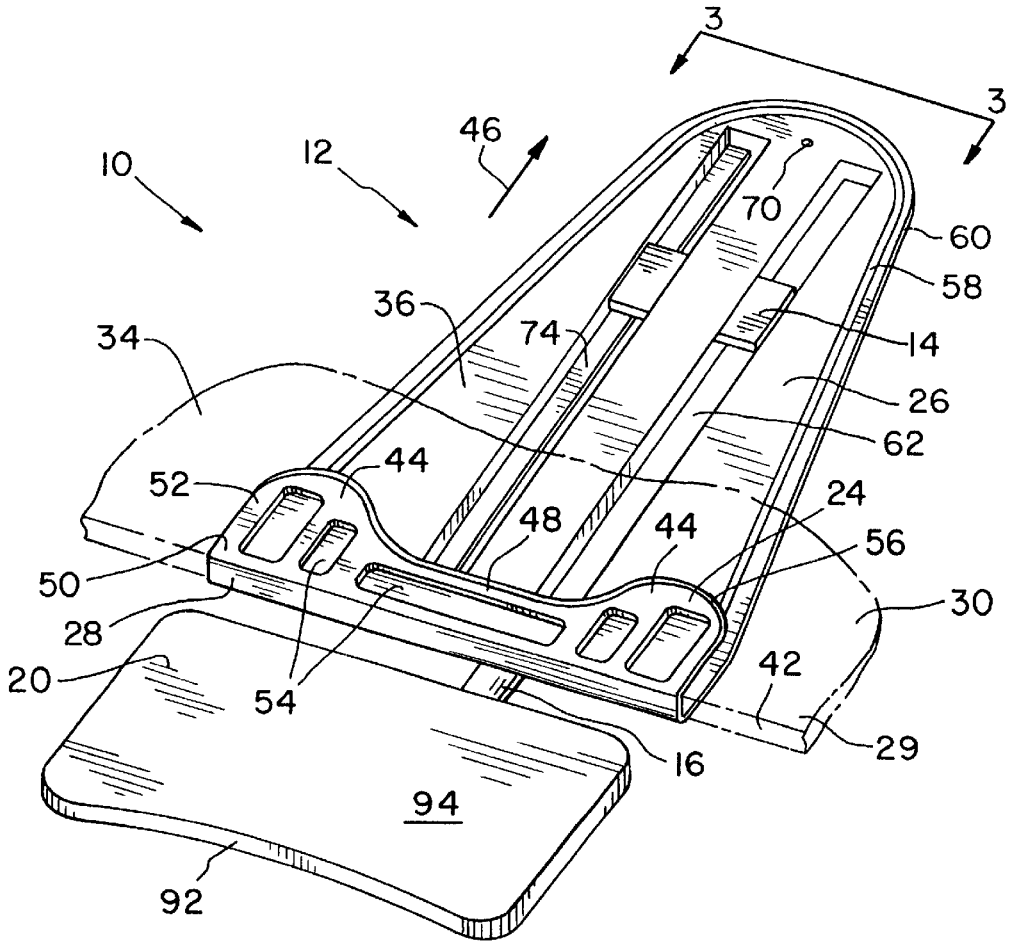
FIG. 1 is a downward, perspective view of one embodiment of the keyboard support system of the present invention.

Mounting bracket 12 includes a top wall 24 and a bottom wall 26 which are resiliently interconnected by a middle wall 28. Mounting bracket 12 can be slid over an edge 29 (FIG. 1) of a work surface 30 such that work surface 30 is secured between top wall 24 and bottom wall 28. More particularly, middle wall 28 provides a resilient force that biases a lower surface 32 of top wall 24 against a working surface 34 of work surface 30, and biases an upper surface 36 of bottom wall 26 against an underside 38 of work surface 30. In the most advanced position of mounting bracket 12, as shown in FIG. 1, an inner surface 40 (FIG. 3) of middle wall 28 contacts a side 42 of work surface 30. Mounting bracket 12 may be molded from plastic, formed out of metal, or die cast out of aluminum, for example.

Top wall 24 includes two nodes 44 on opposite lateral sides of top wall 24. In the unbiased state of mounting bracket 12, top wall 24 slants slightly downward toward bottom wall 26 as top wall 24 extends away from middle wall 28 in a direction indicated by arrow 46, which direction is perpendicular to middle wall 28. Because nodes 44 are closer than a middle portion 48 of top wall 24 to bottom wall 26, the clamping force exerted by nodes 44 is greater than the clamping force exerted by a middle portion 48. Since the clamping force is maximized at both nodes 44 at the opposite lateral ends of top wall 24, pivoting of bracket 12 about a single point of maximum clamping force is avoided. In this way, nodes 44 allow bracket 12 to be more securely attached to work surface 30.

An upper surface 50 of top wall 24 is formed by a work tray 52 which snaps onto top wall 24. Work tray 52 includes variously shaped and sized indentations or cavities 54 which may be used to retain stationary supplies such as paper clips, note pads, etc. Each indentation 54 has a surface area suitable for containing such supplies, for example, at least one square inch. Depending upon the needs of the user, work tray 52 may be detached from top wall 24 and replaced with another work tray (not shown) which has different indentations. In another embodiment, indentations 54 are integrally formed in the upper surface of a monolithic top wall.

Top wall 24 has a maximum depth $d_t$ (FIG. 4) at nodes 44, as measured in direction 46. Depth $d_t$ of top wall 24 is, however, much less than a depth $d_b$ of bottom wall 26.

The outside edge of top wall 24 has an outwardly flanged lip 56 which projects away from working surface 34 of work surface 30 in order to avoid scratching it.

Bottom wall 26 has a width w as measured in a direction parallel to middle wall 28. As is readily apparent, width w of bottom wall 26 decreases in direction 46.

Bottom wall 26 is fabricated from a formable or bendable material, such as sheet metal, For example. In order to improve structural integrity, bottom, wall 26 has a stiffening rib 58 extending along and adjacent to a perimeter 60 of bottom wall 26. Stiffening rib 58 provides bottom wall with increased rigidity, thereby increasing the clamping force exerted by mounting bracket 12.

A pair of opposing, side by side guide rails 62 are integrally fabricated from or attached to bottom wall 26. Guide rails 62 project from a lower surface 64 of bottom wall 26. A length 66 of guide rails 62 is oriented parallel to lower surface 64 and bottom wall 26 in direction 48. Length 66 extends between two longitudinal ends 68 of each guide rail 62. Bottom wall 26 includes a threaded through hole 70, disposed beyond and adjacent to longitudinal ends 68, for receiving knob 22. Proximal portions 72 of guide rails 62 are oriented substantially perpendicular to lower surface 64, while distal portions 74 of guide rails 62 are oriented substantially parallel to lower surface 64. Thus, proximal portions 72, distal portions 74 and lower surface 64 define a channel 76 for retaining sliding device 14.

In the embodiment shown, sliding device 14 is in the form of a block having rollers (not shown) on its opposite ends. The rollers of sliding device 14 are retained within and roll along channel 76 of guide rails 62. Sliding device 14 is retained between or hands on guide rails 62. The structure or sliding device 14 is well known in the art and is therefore not discussed in detail herein.

Figure 3:
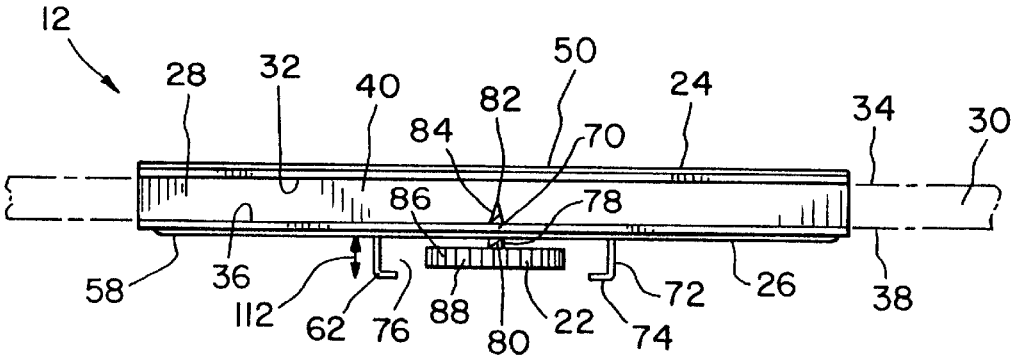
FIG. 3 is a sectional view of the mounting bracket of FIG. 1 along line 3—3.

Knob 22, as best seen in FIG. 3, is attached to a longitudinal end 78 of an elongate element 80. Elongate element 80 extends through through hole 70 such that an opposite, sharp or pointed longitudinal end 82 of elongate element 80 may be embedded in underside 38 of work surface 30. Thus, knob 22 and elongate element 80 anchor bottom wall 26 to underside 38 of work surface 30 such that mounting bracket 12 cannot be inadvertently pulled off of work surface 30. Elongate element 80 includes high pitch threads 84 which allow longitudinal end 82 to penetrate to a sufficient depth within work surface 30 with minimal rotation of knob 22. High pitch threads 84 also allow elongate element 80 to be extracted from work surface 80 with minimal rotation of knob 22. A circumference 86 of knob 22 includes raised serrations or ridges 88 so that knob 22 may be more easily gripped.

Besides providing leverage for the rotation of elongate element 80, knob 22 also serves as a backstop for sliding device 14. That is, knob 22 blocks sliding device 14 from sliding past longitudinal ends 68 of guide rails 62, and thereby becoming disengaged from guide rails 62.

Mounting arm 16 interconnects sliding device 14 and the combination of pivot joint 18 and keyboard platform 20. As seen from FIGS. 1 and 2, mounting arm 16 has only a single degree of freedom relative to bottom wall 26 due to the nature of the slide connection between sliding device 14 and guide rails 62. Mounting arm 16 has sufficient rigidity to support the weight of keyboard platform 20 and a keyboard (not shown) supported thereon. The structure of mounting arm 16 is well known in the art and is therefore not discussed in detail herein.

Pivot joint 18, interconnecting mounting arm 16 and keyboard platform 20, allows limited rotational movement of keyboard platform 20 about pivot joint 18 and relative to mounting bracket 12.

Keyboard platform 20 includes a bottom surface 90, an edge surface 92 and a top surface 94 for supporting a conventional computer keyboard (not shown).

Figure 4:
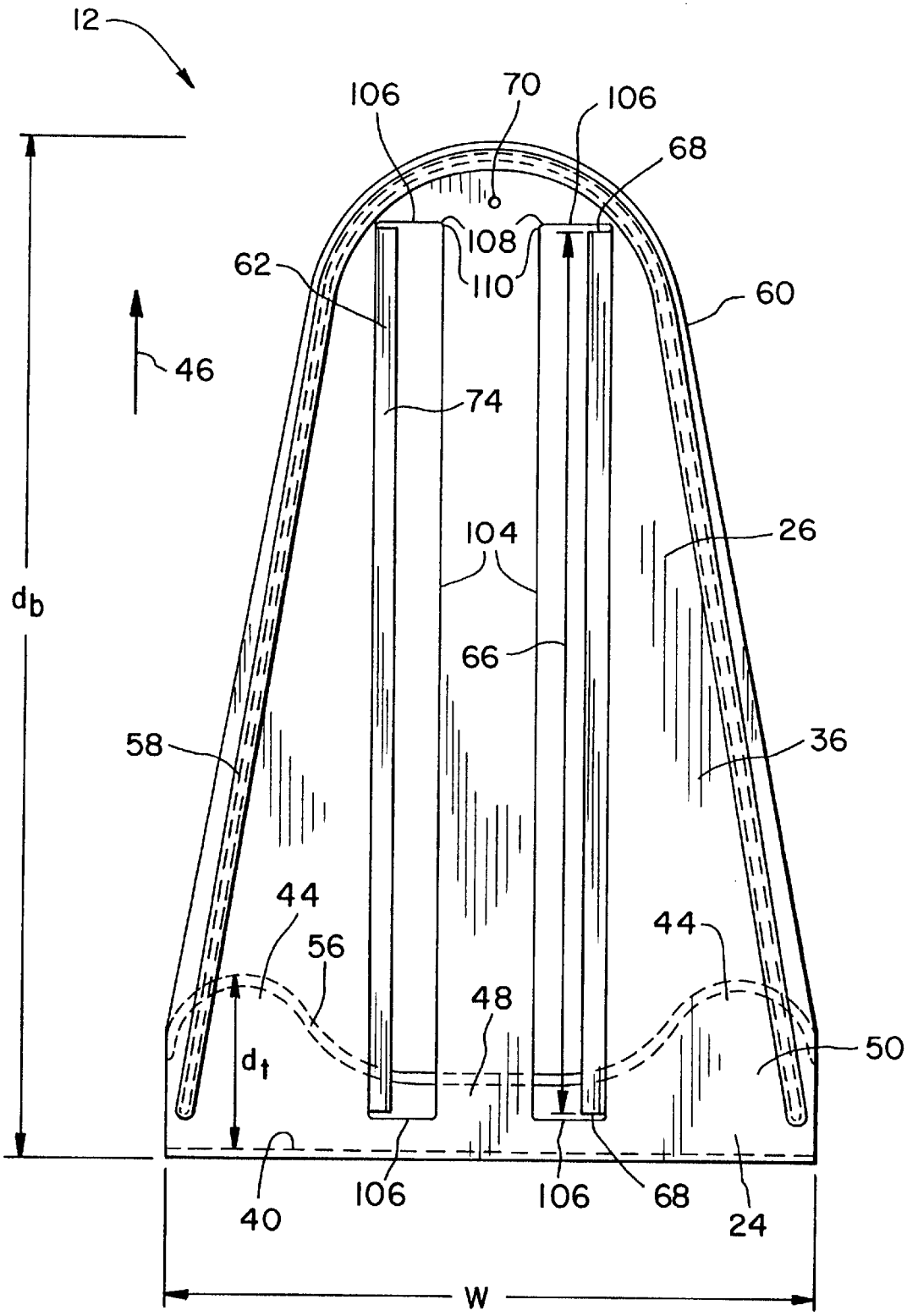
FIG. 4 is a plan view of the mounting bracket of FIG. 1.

During manufacture, one embodiment of integral guide rails 62 are formed in monolithic bottom wall 26 by first cutting two parallel, side by side tabs in the formable sheet of material which is to form bottom wall 26. More particularly, two parallel, side by side, linear slits 104 (FIG. 4) are sliced through the sheet such that each of slits 104 has an approximately equal length. Two pairs of shorter, linear slits 106 are also sliced through the sheet such that each of slits 106 has an approximately equal length. A longitudinal end 108 of each slit 106 is coincident with a respective longitudinal end 110 of a respective slit 104. Each shorter slit 106 is oriented transversely relative to slits 104. Further, as shown in FIG. 4, each slit 106 associated with a same slit 104 is disposed on a same side of slit 104. That is, each of the pair of slits 106 that are associated with the left-hand slit 104 is disposed on the left-hand side of left-hand slit 104, and each of the pair of slits 106 that are associated with the right-hand slit 104 is disposed on the right-hand side of right-hand slit 104. In other words, each of short slits 106 is disposed on the outside of slits 104, i.e., on a side of its associated slit 104 that is opposite the other non-associated slit 104. Each of the two cut tabs, each of which will later be divided into proximal portion 72 and distal portion 74, is partially defined by a respective slit 104 and a respective pair of shorter slits 106.

Each tab is then bent at a right angle, approximately 90° away from upper surface 36 of bottom wall 26, i.e., the side of the sheet of material that is to contact underside 38 of work surface 30. A distal portion 74 of each tab is bent approximately 90° toward the opposing tab, thereby forming a right angle with the remaining proximal portion 72 of the tab. In this position, each distal portion 74 is oriented substantially parallel to the remainder of the sheet of material from which it was cut. Each proximal portion 72 has a height 112 which is substantially less than its length 66. Thus, each tab, including a proximal portion 72 and a distal portion 74, thereby forms a respective guide rail 62 for slidingly retaining sliding device 14 therein.

Figure 5:
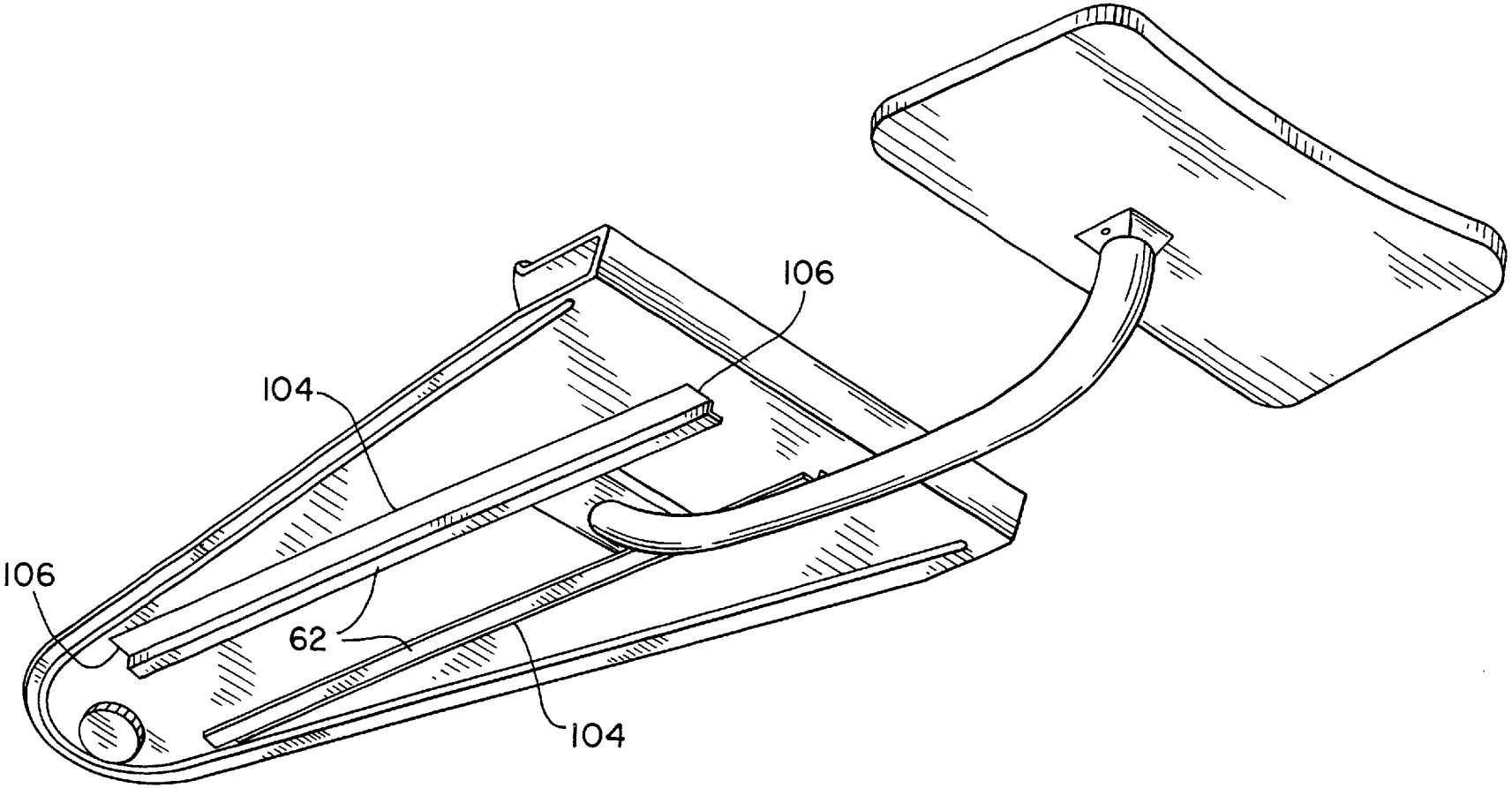
FIG. 5 is an upward, perspective view of another embodiment of a keyboard support system of the present invention.

In another embodiment (FIG. 5), in contrast to FIG. 2, each short slit 106 is disposed on the inside of its associated slit 104. That is, each slit 106 is disposed on a same side of its associated slit 104 as is the other non-associated slit 104. Depending upon whether slits 106 are to be sliced to the inside of slits 104, as in FIG. 5, or sliced to the outside of slits 104, as in FIG. 2, the initial slices which forms slits 104 can be positioned such that the resulting guide rails 52 are a same, desired distance away from each other.

In another embodiment (not shown), top wall 24 of bracket 12 is formed of a transparent material so that note cards or reference documents may be securely held between top wall 24 and working surface 36 of work surface 30 for easy viewing by the user.

In yet another embodiment (not shown), bottom wall 26 has at least one gusset extending in direction 46. The gussets increase the strength and rigidity of bottom wall 26, similarly to stiffening rib 58.

Keyboard platform 20 has been described herein as supporting a keyboard. However, it is to be understood that platform 20 can also be used to support any other type of input device. Such input devices which can be supported by the input device platform may include a mouse or another type of electronic computer input device.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within arrows or customary practice in the art to which this invention pertains and which fall within the limits of the appended claims.

What is claimed is:

1. An input device support system for attachment to an edge of a substantially horizontal work surface, the work surface including a working surface and an underside, said input device support system comprising:

a input device platform configured for supporting an input device;

a substantially U-shaped mounting bracket configured for attachment to the edge of the work surface, said mounting bracket including:

a top wall having a lower surface;

a monolithic bottom wall having an upper surface and a lower surface with a pair of integral, opposing guide rails projecting from said lower surface, each said guide rail having a length oriented substantially parallel to said lower surface of said bottom wall; and a middle wall interconnecting said top wall and said bottom wall, said bottom wall, said middle wall and said top wall together being configured to resiliently bias said lower surface of said top wall against the working surface of the work surface and resiliently bias said upper surface of said bottom wall against the underside of the work surface and thereby being configured to define a means for generating a resilient force to clamp the work surface between said top wall and said bottom wall;

a single sliding device retained between and slidably engaging each of said guide rails of said bottom wall, said sliding device being slidably positioned along said lengths of said guide rails; and a mounting arm rigidly mounted to said input device platform and said sliding device, said mounting arm having a single degree of freedom relative to said bottom wall of said mounting bracket via said sliding device.

2. The input device, support system of claim 1, wherein each said guide rail has two longitudinal ends, said bottom wall including a through hole disposed adjacent to one of said longitudinal ends of at least one said guide rail, said input device support system further comprising an elongate element extending through said through hole in said bottom wall, said elongate element having a sharp longitudinal end configured for being embedded in the underside of the work surface to thereby maintain said input device support system in engagement with the work surface.

3. The keyboard support system of claim 1, wherein, in the unbiased state of said mounting bracket, said top wall slants slightly downward toward said bottom wall as said top wall extends away from said middle wall.

* * * * *